United States Patent [19]

Westhead

[11] 4,202,382

[45] May 13, 1980

[54] DRYER FELTS

[75] Inventor: William T. Westhead, Waycross, Ga.

[73] Assignee: Scapa Dryers, Inc., Waycross, Ga.

[21] Appl. No.: 915,238

[22] Filed: Jun. 13, 1978

[51] Int. Cl.[2] ..... D03D 23/00

[52] U.S. Cl. ..... 139/383 A; 57/210; 57/230; 57/232; 428/245; 428/257; 428/258; 428/375; 428/377

[58] Field of Search ..... 428/245, 257, 258, 259, 428/426, 457, 251, 252, 377, 378, 380, 375; 74/232, 239; 139/383 A; 57/210, 229, 230, 234, 232

[56] References Cited

U.S. PATENT DOCUMENTS

| | | | |
|---|---|---|---|
| 3,631,667 | 1/1972 | Marzocchi | 57/229 |
| 3,644,866 | 2/1972 | Deardurff | 57/229 |
| 3,675,409 | 7/1972 | Rosenstein | 57/230 |
| 3,675,409 | 7/1972 | Rosenstein | 57/229 |
| 3,871,946 | 3/1975 | Romanski et al. | 74/232 |
| 4,015,038 | 3/1977 | Romanski et al. | 428/257 |
| 4,159,618 | 7/1979 | Sokaris | 57/297 |

*Primary Examiner*—James J. Bell
*Attorney, Agent, or Firm*—Fleit & Jacobson

[57] ABSTRACT

A dryer felt comprising a plurality of warp yarns and a plurality of weft yarns interwoven according to a selected weave pattern. A characteristic of the dryer felt being that at least one of the yarns comprises a core fiber made from a synthetic monofilament, a synthetic multifilament, or a synthetic fiber, a first sheath formed by wrapping a first high temperature resistant aramid fiber around the core fiber in a first direction, a second sheath formed by wrapping a second high temperature resistant aramid fiber around the first sheath in a direction different from the first direction, and a covering formed by coating the second sheath with a high temperature resistant resin.

55 Claims, 3 Drawing Figures

DRYER FELTS

BACKGROUND OF THE INVENTION

1. Field of the Invention

This invention relates to papermaking fabrics, in general, and to dryer felts woven from cross-wrapped resin coated yarns, in particular.

2. Description of the Prior Art

In papermaking, the final stage in the process of removing water from a paper web is carried out in a papermaking machine's dryer section. In a typical papermaking machine, the paper web is dried by passing around a series of steam heated cylinders. A dryer felt or dryer fabric in the form of an endless conveyor belt ensures that the paper web is held in intimate contact with the heated cylinders. The dryer section may also employ hot air blowers, situated above or below the dryer felt. These blowers provide hot air, typically in the range of 500° to 800° F., to the paper web, contained on the dryer felt, to further aid in the removal of moisture from the paper web.

There is a tendency for dryer felts to physically and chemically degrade in the environment of high heat and high moisture concentration present in the dryer section. The degredation manifests itself in the form of dimensional variations, tearing or other destruction of the dryer felt. In addition, loss of fabric stability and loss of yarn stability is also manifested. It has been found that the edges of the dryer felt are most suceptible to destruction and degredation. In order to overcome these shortcomings, some paper mills use an air shower to cool the dryer felt after the paper web leaves the fabric. Air showers can also be used to cool the edges of the felt or fabric as it passes under or over the hot air blowers. Such showers, however, cannot cool the exposed edge right up to the paper sheet without disturbing the sheet, and there is, therefore, an area of fabric exposed to direct heat which cannot be cooled.

Even with the air shower, the best synthetic prior art dryer felts are rendered useless in a relatively short period of time. The replacement of a dryer felt is an expensive undertaking, both in terms of direct replacement costs, and machine downtime. There is thus a great need to extend the useful life of a dryer felt.

SUMMARY OF THE INVENTION

In some embodiments of the subject invention there is provided a dryer felt comprising a plurality of warp yarns and a plurality of weft yarns interwoven according to a selected weave pattern i.e., any of the numerous weave patterns known in the prior art. The yarns (hereinafter referred to as cross-wrapped yarns) used to weave the dryer felt each comprise a synthetic core fiber, a first sheath formed by wrapping a first aramid fiber around the core fiber in a first direction, a second sheath formed by wrapping a second aramid fiber around the first sheath in a direction different from the first direction, and a covering formed by coating the second sheath with a high temperature resistant resin.

By using the the cross-wrapped yarn to constitute the warp and weft yarns, the dryer felt of the subject invention exhibits greater stability, temperature resistance, and moisture resistance than has heretofore been possible with prior art dryer felts.

In other embodiments of the subject invention, a dryer felt, as just described, is further coated with a high temperature resistant resin. This additional coating, further enhances the stability, temperature resistance, and moisture resistance of the dryer felt of the subject invention.

It is thus an object of the present invention to provide a dryer felt having a greater stability than has heretofore been possible.

It is another object of the present invention to provide a dryer felt having a greater resistance to the high temperatures found in the dryer section of a papermaking machine than has heretofore been possible.

It is a further object of the present invention to provide a dryer felt having a greater resistance to moisture than has heretofore been possible.

It is still a further object of the present invention to provide a dryer felt having a greater useful life than has heretofore been possible.

Other objects and advantages of this invention will further become apparent hereinafter and in the drawings, in which.

DESCRIPTION OF THE PREFERRED EMBODIMENTS

Figure 1:
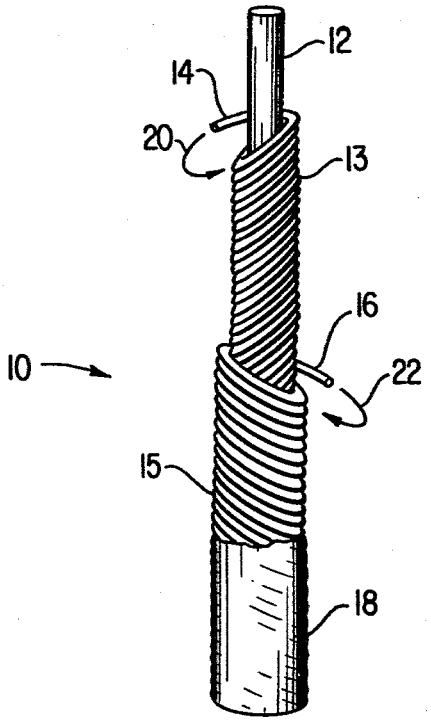
FIG. 1 shows in perspective a cross-wrapped yarn in various stages of assembly.

In describing the preferred embodiment of the invention illustrated in the drawings, specific terminology will be resorted to for the sake of clarity. However, it is not intended to be limited to the specific terms so selected, and it is to be understood that each specific term includes all technical equivalents which operate in a similar manner to accomplish a similar purpose. As used herein, a fiber is a thread or a threadlike structure such as a monofilament, a multifilament, a strand, a yarn, a fibril or a staple.

The subject invention will now be described with reference to FIG. 1. The cross-wrapped yarn, generally designated as 10, is shown in various stages of assembly. At the heart of the yarn 10 is a core fiber 12, which, in this example, is made from a synthetic material, such as polyester. In a preferred embodiment of the subject invention, the core fiber 12 is a monofilament thread of sufficient length to be later woven into a dryer felt. Around the core fiber 12, there is provided a first sheath 13. The sheath is formed by wrapping a fiber 14 around the core fiber 12. The fiber 14, which is made from an aramid fiber, such as NOMEX, manufactured by E. I. DuPont de Nemours & Company or KEVLAR, is carefully wrapped in a counter-clockwise direction around the circumference of the core fiber 12 to form a close fitting, protective, helical covering along the full length of the core fiber 12. The helix formed by wrapping the fiber 14 around the core fiber 12 has a helix angle or wrap angle in the range of about 5° to 85°, with a range of about 40° to 50° being preferred. For purposes of illustration, the direction of wrapping is shown by arrow 20.

Around the first sheath 13, there is provided a second sheath 15. The second sheath is formed by wrapping a fiber 16 around the sheath 13. The fiber 16, which is also made from an aramid material, is carefully wrapped in a clockwise direction around the sheath 13 to form a close fitting, protective, helical covering along the full length of the sheath 13. The helix formed by wrapping the fiber 16 around the first sheath 13 has a helix angle or wrap angle in the range of about 5° to 85°, with a range of about 40° to 50° being preferred. For purposes of illustration, the direction of wrapping is shown by arrow 22.

Around and along the full length of the second sheath 15, there is provided a covering 18 formed by coating the second sheath with a high temperature resistant resin, such as phenolic resin, by any of the known prior art methods.

In another preferred embodiment, the fiber 14 is wrapped in a clockwise direction, while the fiber 16 is wrapped in a counter-clockwise direction.

Figure 2:
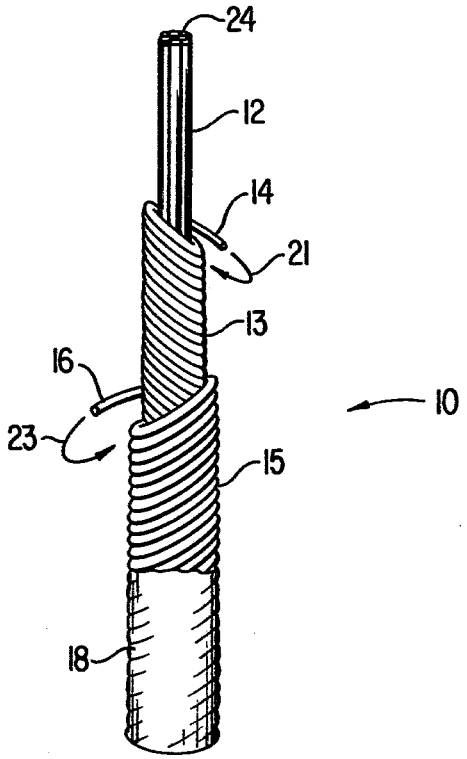
FIG. 2 shows in perspective another cross-wrapped yarn in various stages of assembly.

In yet another preferred embodiment, shown in FIG. 2, wherein like numerals denote like elements, the core fiber 12 is composed of a bundle of synthetic fibers 24, such as polyester, and is treated with a high temperature resistant resin, such as phenolic resin, to cause the bundle to act as a monofilament thread. Around the core fiber 12, there is provided a first sheath 13. The sheath is formed by wrapping a fiber 14 around the core fiber 12. The fiber 14, which is made from an aramid material, such as NOMEX or KEVLAR, is carefully wrapped in a clockwise direction around the circumference of the core thread 12 to form a close fitting, protective, helical covering along the full length of the core thread 12. The helix formed by wrapping the fiber 14 around the core fiber 12 has a helix angle or wrap angle in the range of about 5° to 85°, with a range of about 40° to 50° being preferred. For purposes of illustration, the direction of wrapping is shown by arrow 21.

Around the first sheath 13, there is provided a second sheath 15. The second sheath is formed by wrapping a fiber 16 around the sheath 13. The fiber 16, which is also made from an aramid material, is carefully wrapped in a counter-clockwise direction around the sheath 13 to form a close fitting, protective, helical covering along the full length of the sheath 13. The helix formed by wrapping the fiber 16 around the sheath 13 has a helix angle or wrap angle in the range of about 5° to 85°, with a range of about 40° to 50° being preferred. For purposes of illustration, the direction of wrapping is shown by arrow 23.

Around and along the full length of the second sheath 15, there is provided a covering 18 formed by coating the second sheath with a high temperature resistant resin, such as phenolic resin, by any of the known prior art methods.

In still a further preferred embodiment, the fiber 14 of FIG. 2 is wrapped in a clockwise direction, while the fiber 16 of FIG. 2 is wrapped in a counter-clockwise direction.

Figure 3:
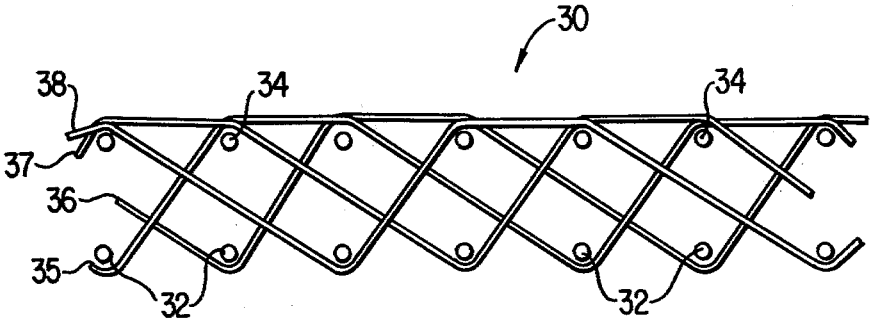
FIG. 3 is a longitudinal section of one possible dryer felt woven with cross-wrapped yarns.

It has been found that a yarn, manufactured as described hereinbefore, contains several attributes which make it ideal for use in a dryer felt. Among these attributes are a higher degree of stability, a high degree of resistance to heat, and a high degree of resistance to moisture. One such dryer felt, shown in FIG. 3, is generally designated as 30. The dryer felt consists of two planes formed by a plurality of weft yarns 32 and a plurality of weft yarns 34. The weft yarns 32 and 34 are bound by warp yarns 35 through 38 to form a duplex weave dryer felt. It is to be understood that any conventional dryer felt consisting of a one, two or three plane fabric will benefit greatly from being woven with a cross-wrapped yarn embodying the subject invention.

It has been found that a dryer felt is functional when it has a permeability range of about 50 to 1000 CFM, and that it performs best within a permeability range of about 100 to 600 CFM. Thus, to provide a dryer felt having these permeability characteristics, the warp and weft yarns of the subject invention should have the following characteristics. The diameter of cross-wrapped warp yarns should be within the range of about 5 to 50 mils, with approximately 16 mils being preferred. The diameter of cross-wrapped weft yarns should be within the range of about 5 to 50 mils, with approximately 20 mils being preferred.

After a dryer felt is woven using the cross-wrapped yarns of the subject invention, the dryer felt may also be treated with a high temperature resistant resin, such as phenolic resin. This treatment will further enhance the overall fabric stability, temperature resistance, and moisture resistance.

Obviously, many modifications and variations of the present invention are possible in light of the above teachings, and it is contemplated that the cross-wrapped yarns of the subject invention may not replace all of the yarns in a dryer felt. It is further contemplated that the core fiber may be made from other materials suitable for dryer felts, such as glass or wire, and that the diameter of each aramid fiber may be larger than, smaller than, or equal to the diameter of the core fiber. It is, therefore, to be understood that within the scope of the appended claims, the invention may be practiced otherwise than as specifically described.

What I claim is:

1. A dryer felt comprising a plurality of warp yarns and a plurality of weft yarns interwoven according to a selected weave pattern, at least one of said yarns comprising a core fiber, a first sheath formed by wrapping a second fiber around said core fiber in a first direction wherein said wrapping of said second fiber forms a close fitting covering entirely around said core fiber, a second sheath formed by wrapping a third fiber around said first sheath in a direction different from said first direction wherein said wrapping of said third fiber forms a close fitting covering entirely around said first sheath, and a covering formed by coating said second sheath with a resin.

2. The dryer felt of claim 1, wherein said resin is a high temperature resistant resin.

3. The dryer felt of claim 1, wherein said resin is a phenolic resin.

4. The dryer felt of claim 1, wherein said weave pattern is a weave pattern for a multiple layer fabric.

5. The dryer felt of claim 1, wherein said weave pattern is a weave pattern for a single layer fabric.

6. The dryer felt of claim 4, wherein said multiple layer fabric is a duplex fabric.

7. The dryer felt of claim 1, wherein said core fiber is a synthetic monofilament.

8. The dryer felt of claim 7, wherein said synthetic monofilament is a polyester filament.

9. The dryer felt of claim 1, wherein said core fiber comprises a plurality of synthetic filaments bundled together, and a covering formed by treating said bundled filaments with a second high temperature resistant resin.

10. The dryer felt of claim 1, wherein said core fiber is made from glass.

11. The dryer felt of claim 1, wherein said core fiber is a wire.

12. The dryer felt of claim 9, wherein said synthetic filaments are polyester filaments, and said second resin is a phenolic resin.

13. The dryer felt of claim 1, wherein said second fiber is made from a temperature resistant aramid material.

14. The dryer felt of claim 1, wherein said third fiber is made from a temperature resistant aramid material.

15. The dryer felt of claim 1, wherein said first direction is a clockwise direction and said different direction is a counter-clockwise direction.

16. The dryer felt of claim 1, wherein said first direction is a counter-clockwise direction and said different direction is a clockwise direction.

17. The dryer felt of claim 1, wherein said second fiber is wrapped around said core fiber in accordance with a first wrap angle in the range of about 5° to 85°, and said third fiber is wrapped around said first sheath in accordance with a second wrap angle in the range of about 5° to 85°.

18. The dryer felt of claim 1, wherein said second fiber is wrapped around said core fiber in accordance with a first wrap angle in the range of about 40° to 50°, and said third fiber is wrapped around said first sheath in accordance with a second wrap angle in the range of about 40° to 50°.

19. The dryer felt of claim 1, wherein said one yarn is a yarn having a diameter in the range of about 5 to 50 mils.

20. The dryer felt of claim 1, wherein said one yarn is a warp yarn having a diameter of approximately 16 mils.

21. The dryer felt of claim 1, wherein said one yarn is a weft yarn having a diameter of approximately 20 mils.

22. The dryer felt of claim 1, wherein at least one of said second and third fibers has a diameter which is smaller than the diameter of said core fiber.

23. The dryer felt of claim 1, wherein at least one of said second and third fibers has a diameter which is greater than the diameter of said core fiber.

24. The dryer felt of claim 1, wherein at least one of said second and third fibers has a diameter substantially equal to the diameter of said core fiber.

25. The dryer felt of claim 1, wherein said yarns after being interwoven are coated with a second high temperature resistant resin.

26. The dryer felt of claim 25, wherein said second resin is a phenolic resin.

27. A dryer felt comprising a plurality of warp yarns and a plurality of weft yarns interwoven according to a selected weave pattern, at least one of said yarns comprising a polyester core fiber, a first sheath formed by wrapping a first heat resistant aramid fiber around said core fiber in a first direction wherein said wrapping of said first heat resistant aramid fiber forms a close fitting covering entirely around said polyester core fiber, a second sheath formed by wrapping a second heat resistant aramid fiber around said first sheath in a direction different from said first direction wherein said wrapping of said second heat resistant aramid fiber forms a close fitting covering entirely around said first sheath, and a covering formed by coating said second sheath with a high temperature resistant resin.

28. The dryer felt of claim 27, wherein said resin is a phenolic resin.

29. The dryer felt of claim 27, wherein said weave pattern is a weave pattern for a multiple layer fabric.

30. The dryer felt of claim 27, wherein said core fiber is a monofilament.

31. The dryer felt of claim 27, wherein said core fiber comprises a plurality of fibers bundled together, and a covering formed by treating said bundled fibers with a second high temperature resistant resin.

32. The dryer felt of claim 31, wherein said second resin is a phenolic resin.

33. The dryer felt of claim 27, wherein said first direction is a clockwise direction and said different direction is a counter-clockwise direction.

34. The dryer felt of claim 27, wherein said first direction is a counter-clockwise direction and said different direction is a clockwise direction.

35. The dryer felt of claim 27, wherein said one yarn is a yarn having a diameter in the range of about 5 to 50 mils.

36. The dryer felt of claim 27, wherein said one yarn is a warp yarn having a diameter of approximately 16 mils.

37. The dryer felt of claim 27, wherein said one yarn is a weft yarn having a diameter of approximately 20 mils.

38. The dryer felt of claim 27, wherein said first fiber is wrapped around said core fiber in accordance with a first wrap angle in the range of about 5° to 85°, and said second fiber is wrapped around said first sheath in accordance with a second wrap angle in the range of about 5° to 85°.

39. The dryer felt of claim 27, wherein said first fiber is wrapped around said core fiber in accordance with a first wrap angle in the range of about 40° to 50°, and said second fiber is wrapped around said first sheath in accordance with a second wrap angle in the range of about 40° to 50°.

40. The dryer felt of claim 27, wherein said yarns after being interwoven are coated with a second high temperature resistant resin.

41. The dryer felt of claim 40, wherein said second resin is a phenolic resin.

42. A dryer felt comprising a plurality of warp yarns, each warp yarn having a diameter in the range of about 5 to 50 mils, and a plurality of weft yarns, each weft yarn having a diameter in the range of about 5 to 50 mils, interwoven according to a selected weave pattern, at least one of said yarns comprising a polyester core fiber, a first sheath formed by wrapping, in accordance with a first wrap angle in the range of about 5° to 85°, a first heat resistant aramid fiber around said core fiber in a first direction wherein said wrapping of said first resistant aramid fiber forms a close fitting covering entirely around said core fiber, a second sheath formed by wrapping, in accordance with a second wrap angle in the range of about 5° to 85°, a second heat resistant aramid fiber around said first sheath in a direction different from said first direction wherein said wrapping of said second heat resistant aramid fiber forms a close fitting covering entirely around said first sheath, and a covering formed by coating said second sheath with a high temperature resistant resin.

43. The dryer felt of claim 42, wherein said resin is a phenolic resin.

44. The dryer felt of claim 42, wherein said weave pattern is a weave pattern for a multiple layer fabric.

45. The dryer felt of claim 42, wherein said weave pattern is a weave pattern for a single layer fabric.

46. The dryer felt of claim 42, wherein said core fiber is a monofilament thread.

47. The dryer felt of claim 42, wherein said core fiber comprises a plurality of filaments bundled together, and a covering formed by treating said bundled filaments with a second high temperature resistant resin.

48. The dryer felt of claim 47, wherein said second resin is a phenolic resin.

49. The dryer felt of claim 42, wherein said first direction is a clockwise direction and said different direction is a counter-clockwise direction.

50. The dryer felt of claim 42, wherein said first direction is a counter-clockwise direction and said different direction is a clockwise direction.

51. The dryer felt of claim 42, wherein said one yarn is a warp yarn having a diameter of approximately 16 mils.

52. The dryer felt of claim 42, wherein said one yarn is a weft yarn having a diameter of approximately 20 mils.

53. The dryer felt of claim 42, wherein said first wrap angle is in the range of about 40° to 50° and said second wrap angle is in the range of about 40° to 50°.

54. The dryer felt of claim 42, wherein said yarns, after being interwoven are coated with a second high temperature resistant resin.

55. The dryer felt of claim 54, wherein said second resin is a phenolic resin.

* * * * *